United States Patent [19]

Engel

[11] Patent Number: 4,735,418

[45] Date of Patent: Apr. 5, 1988

[54] PUZZLE AMUSEMENT DEVICE

[76] Inventor: Douglas A. Engel, 2935 W. Chenango, Englewood, Colo. 80110

[21] Appl. No.: 22,406

[22] Filed: Mar. 6, 1987

[51] Int. Cl.[4] ..... A63F 9/08

[52] U.S. Cl. ..... 273/155

[58] Field of Search ..... 273/155

[56] References Cited

U.S. PATENT DOCUMENTS 4,240,858 12/1980 Lamlee .

OTHER PUBLICATIONS

"V-Flexing the Hexaflexagon" by T. Bruce McLean, The American Mathematical Monthly, vol. 86, No. 6, Jun-Jul. 1979, pp. 457-666.

*Primary Examiner*—Anton O. Oechsle

[57] ABSTRACT

Puzzles are comprised of linked loops, where the loops are made by first making flat strips of equilateral triangles by hinging the triangles together at their edges and then folding the strips at the hinges and then connecting the end triangles together to form a twisted loop that has the overall form of a flattened hexagon known in the literature of recreational mathematics as a hexaflexagon. The linked loops are linked hexaflexagons and the loops can be shifted and folded into many different 2 and three dimensional positions with respect to the loops they are linked to. The resulting linked loop puzzles have been now named as slipagons since they can be shifted by sliding loops with respect to the loops they are linked to as well as by folding. The loops can be linked in many ways to form puzzles of greatly varying difficulty where the object of the puzzle can be to get from one shifted geometric form to another or to get a figure drawn on the loops of the puzzle into some given arrangement.

15 Claims, 2 Drawing Sheets

PUZZLE AMUSEMENT DEVICE

BACKGROUND OF THE INVENTION

1. Field of the Invention

The present invention relates generally to puzzles and amusement devices. However, in view of the nature of this invention as a new idea for studying self organizing structures, it may also be profitably applied as an educational device, and a device of mathematical interest, and a scientific research device. More specifically, the present invention relates to a puzzle or amusement device incorporating flat strips made of hingedly connected triangles folded into hexagonal loops which loops are then linked together, and the linked loops can then be moved in certain ways with respect to the loops they are linked to, providing a puzzle of great interest with the ability to form many different geometric forms.

2. Brief description of the prior art

Because this invention is based upon hexaflexagons, not many patents in this field exist. Hexaflexagons were invented in 1939 by the mathematician Arthur H. Stone. A full explanation of the different kinds of hexaflexagons can be found in "The Scientific American Book of Mathematical Puzzles and Diversions", Simon and Schuster, Inc. NY, NY, 1959, by Martin Gardner. Various toys and puzzles exist that consist of tetrahedrons or cubes hinged together at their edges to form chains, which chains are then sometimes hinged together at their ends to form loops. The puzzle is, then, to fold the object into a given form such as a larger cube or tetrahedron.

A well known puzzle is Rubick's Snake which consists of a chain formed of 45 degree wedges pinned rotatably together at the smaller faces into a long chain. Another well known puzzle is the, just introduced, Rubiks Magic puzzle which consists of 6 plastic squares held together by string wound on the diagonal in the manner of a double hinge. None of these chainlike, presently existing, puzzles has both a completely natural form and a natural extendability so that more and more complex and difficult puzzles can be based upon it in the manner of a natural mathematical-like sequence. The present invention is an attempt to remedy this condition by providing a puzzle that is at once so simple that anyone can understand it, yet it can be extended merely by adding more elements to make puzzles of more and more difficulty and complexity, perhaps without a foreseeable end. Since the present puzzle consists of twisted loops of flat hingedly connected triangles it has some of the features of some of the self organizing structures found in biology and is not without interest for mathematicians and scientists and should therefore prove to be valuble in education and research.

OBJECTS AND SUMMARY OF THE INVENTION

It is the principle object of the present invention to provide a puzzle made of linked loops of hinged triangles that can be folded and, or slipped or shifted into different positions by selectively folding and, or slipping different coded portions of the puzzle and thereby, eventually, completing a cycle of motions that can be repeated over and over until the puzzle finally returns to the beginning position. In this specification any reference to slipping means a gliding motion where one element is folder over another element and so both elements can be caused to move in a gliding motion with respect to each other and the word slip is used to refer to the fact that one thin planar element is being slipped between another thin planar element folded around it.

It is a related object of the present invention to provide an educational or amusement device that can be made more complex and difficult by adding more linked loops of hinged triangles, thereby greatly increasing its interest and utility.

It is a furthur object of the present invention to provide an amusment or research device that can be used to experimentally derive self organizing properties by examining a given sequence of structures as they are made more and more complex in some given order. The words 'self organizing' are justified here because the solution of such a sequence may require a solution of a sequence of forms, each building on properties discovered in the previous orders of the sequence. The DNA molecule is also built of twisted, linked forms and undergoes a great complex of folding and motions.

In accordance with the objects of the present invention we begin the invention with the making of a trihexaflexagon. A trihexaflexagon is explained in the literature of recreational mathematics as a strip of 9 equilateral triangles folded into a loop so as to form a hexagonal shape. The strip of 9 triangles can be folded from a rectangular paper strip of 10 equilateral triangles, then glued on the first and 10th triangles after folding into a twisted loop. A trihexaflexagon may be turned inside out by pushing 3 opposite vertices of the hexagon together then folding 3 vertices, from the opposite side, so that the trihexaflexagon opens into a hexagon again. This operation is called flexing. When this operation is repeated several times the trihexaflexagon returns to it's original position, so that code marks or other indicia marked on it resume the exact positions they had to begin with. Since trihexaflexagons are well known in the litereature they, by themselves, are not the object of this invention but do form a basic element of this invention in some embodiements of this invention. Two trihexaflexagons may be linked together by sliding a strip of triangles into a trihexaflexagon and then folding and gluing this strip into a trihexaflexagon as well. The structure produced may then be called a slipagon because it can be both slipped and 'flexed', and it can be specifically called a 2 slipatrihexaflexagon. It is called a sligagon because the 2 looped trihexaflexagons can be slided in relation to one another and the 2 trihexaflexagons may also be folded over and over, and thus flexed independently.

If arrows or other indicia are marked on the various trihexaflexagons of a slipagon it is possible to move the arrows about by flexing or by sliping of both by flexing and by sliping. It then becomes a difficult puzzle to get the arrows or other indicia back to their original positions.

In the same way that 2 trihexaflexagons can be linked together 3 of more trihexaflexagons can also be linked together to form more difficult slipagons. Even more difficult slipagons can be formed by linking a chain of links back into a loop, thus forming a loop of linked loops. For instance a loop of 6 linked trihexaflexagons forms a puzzle of extraordinary interest, fascination and difficulty. The possibilities for forming more and more difficult and interesting puzzles by this means are truly endless.

It is a furthur object of this invention to provide a device that can be dissassembled and reassembled into new and different devices by undoing some of the trihexaflexagon loops and relinking them together in new ways. This provides the user with an endless array of interesting puzzles of any difficulty desired.

It is still a furthur object of this invention to provide a device that can be folded and or slipped into new 2 and or 3 dimensional forms from which it is difficult to return, by folding and, or slipping, to it's original form.

It is yet another object of this invention to provide a device that can be made of other types of hexaflexagons in any mix such as trihexaflexagons linked to hexahexaflexagons and so forth. The more complex or higher order hexaflexagons provide a much more difficult and interesting puzzle, and in fact have many surprising properties, many of which are presently unknown. While the construction of the more complex hexaflexagons is not explained here, they are well known in the literature, and the method of linking them together is essentially the same as that used for linking trihexaflexagons.

I contend that my invention represents a new and extremely interesting combination of elements that is not at all obvious and deserves to be brought to the public since it represents a new, previously unknown form of great interest.

BRIEF DESCRIPTION OF THE DRAWINGS

FIG. 14c shows a slipagon diagram in the shape of a cube. This structure has been built and it can be collapsed and partially flexed and opened back to its solid appearing form.

DESCRIPTION OF THE PREFERRED EMBODIMENTS

Figure 1:
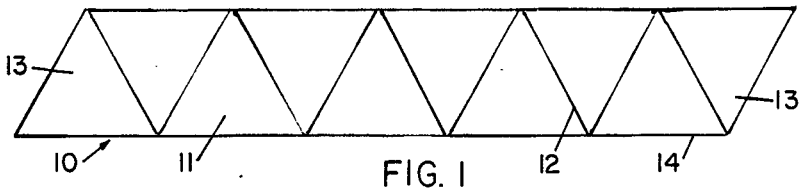
FIG. 1 is a view of a strip of 10 equilateral triangles hinged together at adjacent edges. This strip will be used to describe the manufacture of a trihexaflexagon.
Figure 2:
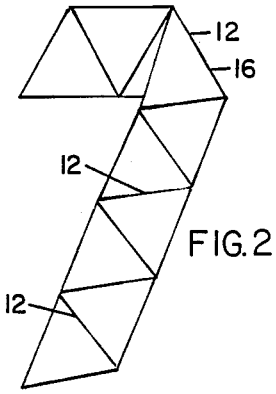
FIG. 2 is a view of the strip being folded once.
Figure 3:
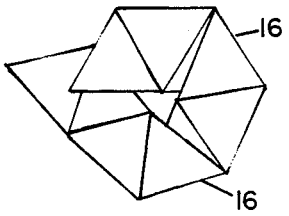
FIG. 3 is a view of the strip being folded a second time.
Figure 4:
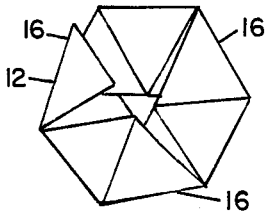
FIG. 4 is a view of the strip being folded a final time.
Figure 5:
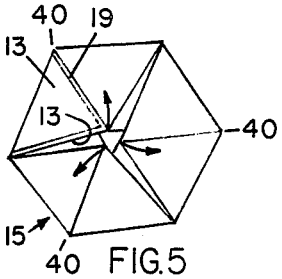
FIG. 5 shows how the 10th triangle is glued to the first triangle to form the completed trihexaflexagon made of exactly 9 equilateral triangles.
Figure 6:
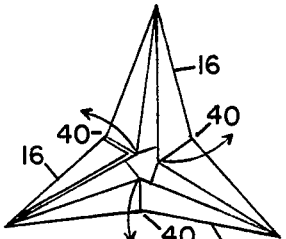
FIG. 6 shows the beginning process of flexing the trihexaflexagon inside out by bringing the appropriate 3 alternate vertices of the hexaflexagon together.
Figure 7:
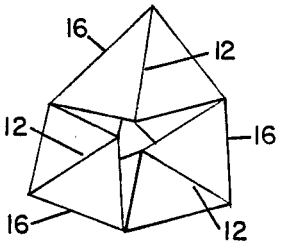
FIG. 7 shows the rest of the process of flexing the trihexaflexagon inside out by separating 3 vertices from the former center of the hexaflexagon.

The basic structrual elements of an amusement device formed in accordance with the present invention are hexaflexagons. FIG. 1 show a strip element 10 of ten equilateral triangle elements 11 with two end triangles 13, and 13 and the triangles are hingedly connected at adjacent edges 12 and each element 11 has an edge 14 that is not used as a hinge edge. Progress to FIG. 2 which shows the first fold 16 of one of the hinges 12. FIG. 2 shows two other hinges 12 which still need to be folded to make the trihexaflexagon element. FIG. 3 now shows that two folds 16 have been made. FIG. 4 shows the final fold 16 at a fold hinge 12 along with the other two folds 16 and 16 that have already been made. Finally FIG. 5 shows how the tenth end triangle element 13 is glued or fixedly attached by other means such as staples, weld or tape to the other end triangle element 13 to form the single ninth triangle element 19. The strucutre illustrate in FIG. 5 is the loop element 15 and is a trihexaflexagon. The loop element 15 is a twisted continuous loop of hingedly connected triangles where the twist is obtained by the way the hinges are folded before the ends of the strip are finally connected to form the continuous loop element 15. In order to build any hexaflexagon loop element it is necessary that enough twist exist in the loop to restrict the loop to a hexagon shape of 6 triangles on both sides when it is laid out flat. Higher order hexaflexagons, such as hexahexaflexagons made from longer strips of hingedly connected triangles, may also be used to build embodiments of my invention, and these kinds of higher loop elements must also satisfy the requirement of just the right amount of twist. For instance trihexaflexagons may be linked to hexahexaflexagons in many different ways, and hexahexaflexagons may be linked to other hexaflexagons to create puzzles of great difficulty and interest. FIG. 5 also shows three arrows leading away from three of the inner vertices of the trihexaflexagon loop element 15. These three vertices, indicated by the arrows in FIG. 5, are to be separated by first bringing the vertices 40 downward and together to form a radially pinched structure shown in FIG. 6. In FIG. 6 the three arrows are again shown and the three folded hinges 16 are also shown along with the vertices 40. Finally, FIG. 7 shows how the pinched structure in FIG. 6 has been opened out as indicated by the arrows in FIG. 6 and once again forms into a hexagonal shape but has acquired the three new folded hinges 16 whereas the previous folded hinges 16 in FIG. 6 have now become unfolded hinges 12 in FIG. 7.

Figure 8:
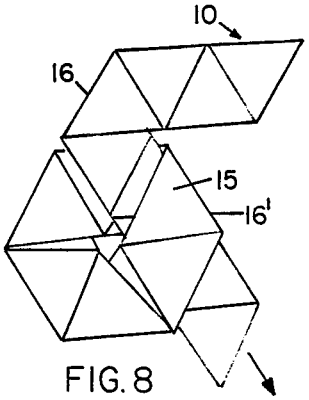
FIG. 8 shows the beginning of the process of linking one trihexaflexagon to another trihexaflexagon.
Figure 9:
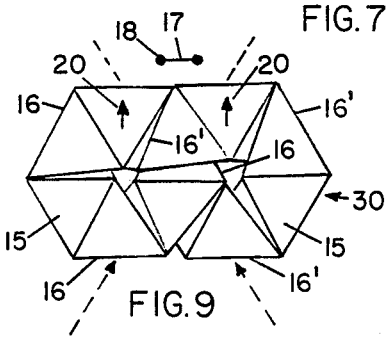
FIG. 9 Shows the 2 linked trihexaflexagons and it is therefore the simplest possible slipagon. Each of the hexagonal loops of this structure can be flexed or folded to new positions with respect to one another. Each of the hexagonal loops of the structure depicted in FIG. 9 can also be slipped one against the other to new positions with respect to one another.

The trihexaflexagon loop element 15 can now be linked to another loop element 15 by inserting a strip 10 between one of the folds 16' in FIG. 8 and then folding the inserted strip 10 into a new loop elements 15 as explained previously for FIG. 5. FIG. 8 shows the first fold 16 being made upon the inserted strip 10. FIG. 9 shows the linked 2-loop structure 30. The two linked loop elements 15 and 15 have three folds 16 in one element 15 and three folds 16' in the other element 15. FIG. 9 also shows a slipagon diagram that represents 30 indicated by the node element 18 and the link line element 17. The node elements 18 represent loop elements and the link line elements 17 represent the way the loops are linked together. Other figures in this specification will also contain slipagon diagrams where appropriate to show how the elements 15 are linked at a glance and to provide a convenient means for discussion of methods of creating slipagons of many different kinds.

FIG. 9 represent the simplest slipagon possible since it is formed on only two linked loop elements 15. FIG. 9 also shows two arrow indicia 20 fixedly marked on each of the two loop elements 15. This arrow indicia in FIG. 9 can be moved about by sliping or sliding the elements 15 by choosing one of the slide directions shown by the dotted arrows in FIG. 9. The arrow indicia in FIG. 9 can also be moved by flexing either one or both of the loop elements 15 as previously described by the description of the FIGS. 5, 6, and 7. A puzzle that is not too difficult is to get the arrow indicia back as shown in FIG. 9 after they are moved about with respect to one another by several slips and folds of the elements 15. Most slipagon puzzles can be either slipped or flexed or both. There may be several positions that a slipagon can be gotten into where either slipping or flexing becomes highly restricted. Getting the slipagon back to a normal position may then become extremely difficult.

Figure 10:
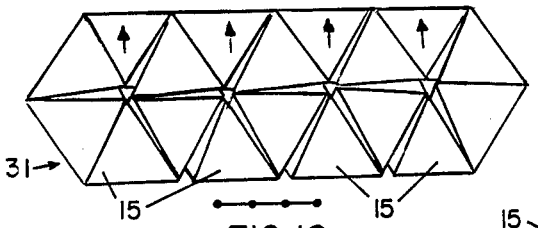
FIG. 10 shows 4 trihexaflexagons linked together into a larger slipagon puzzle structure.

FIG. 10 is a chain slipagon puzzle 31 of four linked elements 15 and also shows the slipagon diagram for these four linked elements. The four arrows in FIG. 10 are indicia fixedly marked upon each of the four loop elements 15. These arrows can be moved about in many ways with respect to each other by flexing and or slipping the four loop elements 15 in FIG. 10. It is a pleasant puzzle figuring out how to restore the indicia to their original positions after moving them about at random by flexing and or slipping the four loop elements 15 in FIG. 10.

Figure 11:
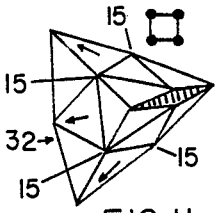
FIG. 11 shows 4 trihexaflexagons linked into a loop to form a tetrahedron shaped slipagon puzzle. This puzzle can be flexed and or slipped into several different kinds of forms.

FIG. 11 illustrates a loop puzzle 32 of four linked loop elements 15 and its slipagon diagram appears with it as four nodes connected by four line links to form a square. FIG. 11 shows the puzzle 32 as a regular tetrahedron but the puzzle 32 can assume many other forms by the operations of slipping and flexing as previously explained, and it can be exceedingly difficult to restore it to the tetrahedral form if it is gotten into a much different form. The three arrow indicia in FIG. 11 are to be complemented by a fourth arrow behind the middle arrow in FIG. 11 and on the opposite side of the puzzle 32.

Figure 12:
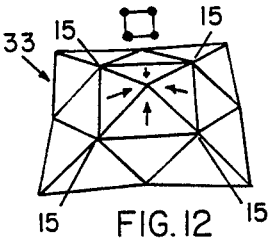
FIG. 12 shows 4 trihexaflexagons linked into a loop to form a half of an octahedron shape. This puzzle can be gotten into many different geometric forms.

FIG. 12 is a perspective sketch of another loop puzzle 33 of four linked loop elements 15 along with its slipagon diagram. The slipagon diagram in FIG. 12 appears identical to the slipagon diagram in FIG. 11 but the puzzle 33 pictured in FIG. 12 is a distinctly different structure from the puzzle 32 shown in FIG. 11. The reason for this is that a different twist was given to the chain of four linked loop elements 15 before it was connected into a loop in the same manner that different twists may be given to moebius bands before connecting them into loops. The structure 33 illustrated in FIG. 12 is flexible, and the four arrow indicia may be mixed up and then restored. The puzzle 33 in FIG. 12 also has several forms different from the octahedral cap illustrated in FIG. 12, and some of these forms can be very difficult to return from, to the octahedral cap form.

Figure 13:
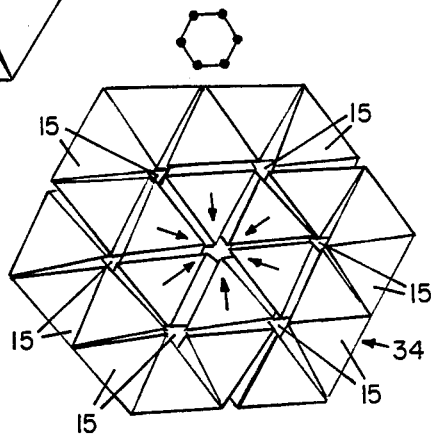
FIG. 13 shows 6 trihexaflexagons linked into a loop that has the shape of a large hexagon. This slipagon puzzle is interesting since one of its forms is a large hexagon shape.

FIG. 13 is an overhead sketch view of a loop 34 of six linked loop elements 15 along with it's slipagon diagram. The six arrow indicia shown on the loop elements 15 of the loop puzzle 34 can be thoroughly mixed up and then restored but restoration can be very difficult. The puzzle 34 has a great many different forms. Loops of six linked loop elements 15 can be connected in several distinctly different ways not shown in any of the figures.

Figure 14:
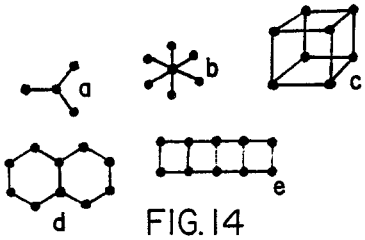
FIG. 14 shows some of the other slipagon puzzles possible by means of the slipagon diagram technique where each dot respresent a hexaflexagon and each line connecting 2 dots represent the linkage between the two hexaflexagons represented by the dots.

FIG. 14 shows five different slipagon diagrams of other structures that can be made by linking the elements 15 as indicated by the diagrams a, b, c, d and e. The diagram a in FIG. 14 shows a basic branched slipagon structure. The diagram b in FIG. 14 shows the maximum number of branches possible at a single loop element 15 by linking the loop elements 15 to it. The diagram c in FIG. 14 shows a cubic method of linking the loop elements 15. The structure indicated by diagram c has been made by the present inventor and it can be collapsed and then opened back out to a three dimensional form in a new position. A deceptive puzzle could be made by eliminating one of the connecting link lines in diagram c thereby obtaining a structure that could be gotten into many positions that the puzzle of diagram c could not be gotten into and making it appear that the structure was still the same as that of diagram c. A slipagon puzzle with the slipagon diagram of FIG. 14 d was made by the present inventor. It has proven to be one of the most difficult slipagon puzzles so far discovered and it can be gotten into positions from which it may take a person hours to get back to some simple starting position. The structure of diagram e shows how many other slipagons can be made simply by designing diagrams and then checking out all possible ways of building the structures represented by a single diagram of linking and looping the loop elements 15, or by linking and looping more complicated hexaflexagon loop elements.

Figure 15:
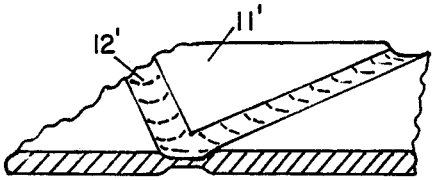
FIG. 15 shows one method of manufacturing slipagons by means of a scored plastic strip of a self hinging plastic such as polypropylene. This material is particularly useful because it has a low coefficient of friction and makes slipping of the slipagon puzzles very easy.

FIG. 15 shows a perspective view of a portion of a self hinging plastic strip with triangle elements 11' and hinge elements 12'. Strips of this kind can easily be made with appropriate press rollers having dies for creating the hinge depressions as the plastic strip is pressed and rolled between the rollers. Several very good, well known, readily available, cheap, self hinging plastics exist and would work well to build the many embodiments of my invention.

Figure 16:
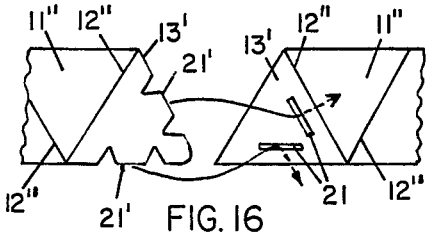
FIG. 16 shows how the 10th triangle may be removably joined to the first triangle by means of notched edges in the 10th triangle and slots in the 1st triangle.

FIG. 16 shows a plan view of the two ends of a strip of ten equilateral triangle elements 11'' with hinge elements 12'' and end triangles 13'. The end triangles 13' in FIG. 16 illustrate how a self hinging plastic strip or other, suitable kind of strip of triangle elements 11'' could be provided with notch elements 21' in one end element 13' to mate with notch elements 21 in the other end element 13' so as to provide a loop element 15, as previously described, that can be quickly disassembled and unlinked from other loop elements 15 and then reassembled and linked in new ways to other loop elements 15 to create many different kinds of slipagon structures.

Figure 17:
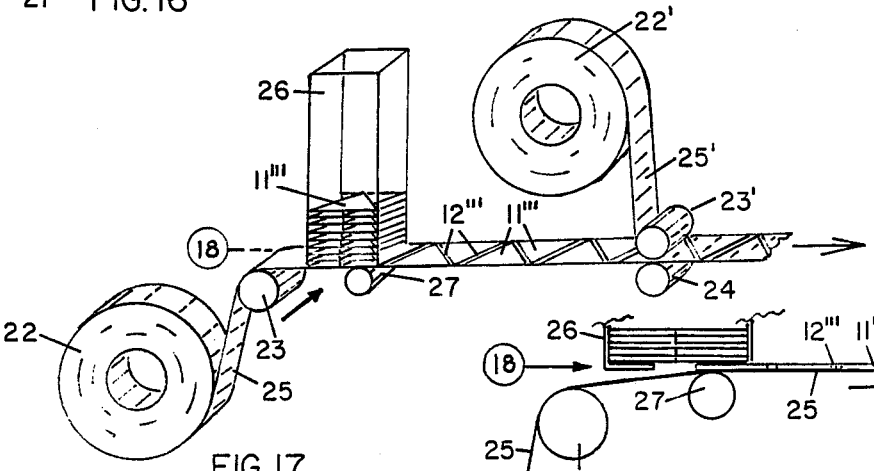
FIGS. 17 and 18 show a means of manufacture of the slipagons with rolls of tape and triangles that are dropped from a hopper onto the tape to form a strip of hingedly connected triangles. The hingedly connected triangles may then be cut into shorter strips and made into hexaflexagons that can be linked together to form slipagons.
Figure 18:
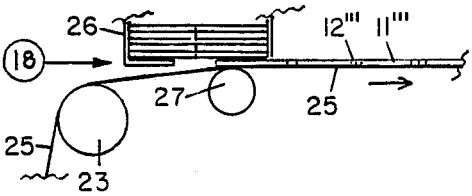

FIG. 17 shows a simple way to manufacture hinged strips of triangles by means of adhesive tape elements 22 and 22', rollers 23 and 23', press roller 24, hopper 26 containing triangles 11" in alternate orientatiions, and roller 27 under the hopper 26. The apparatus works by pulling the tape band 25 under the hopper 26 causing one edge of the triangle elements 11" to fall to the adhesive surface of the tape band 25 as can be seen in the partial frontal section of the hopper bottom in FIG. 18. After the tape band 25 passes under the hopper 26 and collects triangle elements 11" with hinge elements 12" it passes through tape roller 23' and press roller 24 and recieves another adhesive tape band 25' on its top from tape roll 22' completing the assembly of a long strip of hingedly connected equilateral triangles. The hinges are made extra strong from the contact of the adhesive surfaces of the two tape bands 25 and 25'. The width of the hinge elements 12" can be varied by changing the speed at which the tape band passes under the hopper 26. The finished strip of hingedly connected triangles may then be cut into smaller strips, which smaller strips are then used to build the puzzles described by the present invention.

While certain specific embodiments of the present invention have been disclosed as typical, the invention is of course not limited to these particular forms, but rather is broadly applicable to all such variations as fall within the scope of the appended claims.

What is claimed is:

1. A puzzle comprising two or more strips of hingedly connected equilateral triangles, said triangles being made of a suitable thin, stiff material, said strips being constructed by hinging said triangles together by bringing an edge of one said triangle adjacent to an edge of another said triangle and fixing a hinge at said edges, and then repeating said hinging process, to form a non-branched strip of nine or more hingedly connected triangles, each of said strips being formed into continuous loops, said loops being made by first twisting the said strip by folding said triangles on said hinge connections before connecting said hingedly connected equilateral triangles into a loop of hingedly connected equilateral triangles by hinging the first triangle of said strip to the last triangle of said strip, said twist being enough so that said loop is restricted principally to the overall shape of a flattened regular hexagon, but not too much twist so that most of the infolded said triangles of said loop can be brought to the exterior of said hexagon by the operation of bringing 3 alternate vertices of the hexagon shape together and opening 3 central vertices outward to form a hexagon shape once again, and then by repeating said operation as many times as necessary, said loop being linked to another loop by first passing another strip of hingedly connected equilateral triangles through the first said loop and then forming the said strip also into a loop in the manner as described for first said loop, then linking more such loops, if desired, to the first or second said loop, as described, so forming puzzles of more and more difficulty and interest by simply linking more said loops together in different ways such as by a chain of linked loops or by branching by linking three loops to a single loop and by forming a chain of linked loops into an overall loop of linked loops.

2. The invention defined in claim 1 wherein one or more of said loops can be shifted with respect to the loops it is linked to by said folding operation.

3. The invention defined in claim 1 wherein one or more of said loops can be shifted with respect to a loop it is linked to by sliding a said loop along one of the loops it is linked to.

4. The invention defined in claim 1 wherein said loops are provided with disconnecting means so that said puzzles can be assembled, disassembled and reassembled in new ways without limiting the number of loop elements or the way in which they are connected together to form said puzzles.

5. The invention defined in claim 4 wherein said loops can be disassembled and reassembled by providing convex tabs in one of the end triangles of said strip and slots in the other end triangles of said strip to recieve the said tabs providing means for removably connecting said end triangles by mating said tabs to said slots.

6. The invention defined in claim 1 wherein coded indicia are fixedly marked upon one or more said triangles of one or more of said linked loops, said coded indicia being in any form desired such as any combination of symbols, colors, pictures or any other markings.

7. The invention defined in claim 1 wherein the said strips are manufactured by means of a band of adhesive tape passing under a hopper containing equilateral triangles in alternate orientations, said triangles dropping from said hopper one by one onto said adhesive tape so forming a strip of said triangles, said strip then receiving another bnad of adhesive tape on top of the said triangles so forming a completed long strip of hingedly connected triangles where said hinges are formed by the top and bottom adhesive tape junctions between adjacent edges of said triangles, said strip then being cut into smaller strips enabling the construction of said puzzles.

8. The invention defined in claim 1 wherein the said strips are manufactured from a thin, stiff, self hinging plastic material where said hinges are formed by pressing a strip of the said plastic with a die having raised areas that press said plastic forming a thin area in said plastic, said thin area becoming the said hinges in said self hinging plastic strip.

9. The invention defined in claim 1 wherein the said puzzle has the topology of a cube where the vertices of the cube represent the said loops and the edges of the cube represent the way the said loops are linked to each other.

10. The invention defined in claim 1 wherein the said puzzle has the topology of a square where the vertices of the square represent the said loops and the edges of the square represent the way the said loops are linked to each other.

11. The invention defined in claim 1 wherein the said puzzle has the topology of a hexagon where the vertices of the hexagon represent the said loops and the edges of the hexagon represent the way the said loops are linked to each other.

12. The invention defined in claim 1 wherein the said puzzle has the topology of an octagon where the vertices of the octagon represent the said loops and the edges of the octagon represent the way the said loops are linked to each other.

13. The invention defined in claim 1 wherein the said puzzle has the topology of a hexagonal prism where the vertices of said prism represent the said loops and the edges of said prism represent the way the said loops are linked to each other.

14. The invention defined in claim 1 wherein the said puzzle has the topology of a pair of adjacent hexagons having one common edge at said adjacency where the vertices of said hexagons represent the said loops and the edges of said hexagons represent the way the said loops are linked to each other.

15. The invention defined in claim 1 wherein the said puzzle has the topology of a pair of adjacent squares having one common edge at said adjacency where the vertices of said squares represent the said loops and the edges of said squares represent the way the said loops are linked to each other.

* * * * *